United States Patent [19]

Ward

[11] Patent Number: 4,535,930

[45] Date of Patent: Aug. 20, 1985

[54] OVERNIGHT LETTER ENVELOPE

[75] Inventor: James O. Ward, Lake Oswego, Oreg.

[73] Assignee: Nekoosa Envelopes, Inc., Englewood, Colo.

[21] Appl. No.: 570,881

[22] Filed: Jan. 16, 1984

[51] Int. Cl.[3] ..... B65D 27/04; B65D 27/08

[52] U.S. Cl. ..... 229/71; 229/72; 229/74

[58] Field of Search ..... 229/71, 72, 74

[56] References Cited

U.S. PATENT DOCUMENTS

| | | | |
|---|---|---|---|
| 1,205,100 | 11/1916 | Marston et al. | 229/71 |
| 1,387,784 | 8/1921 | Levavr | 229/71 |
| 1,470,291 | 10/1923 | Sawdon | 229/72 |
| 1,865,037 | 6/1932 | Novick | 229/71 |
| 2,097,916 | 11/1937 | Elmor | 229/72 |
| 2,099,007 | 11/1937 | Elmore | 229/72 |
| 2,148,686 | 2/1939 | Durand | 229/72 |
| 2,568,941 | 9/1951 | Benson | 229/72 |
| 3,372,858 | 3/1968 | Brody | 229/74 |
| 3,525,470 | 8/1970 | Carrigan | 229/74 |

FOREIGN PATENT DOCUMENTS

| | | | |
|---|---|---|---|
| 1398947 | 4/1965 | France | 229/72 |

*Primary Examiner*—Stephen P. Garbe

*Attorney, Agent, or Firm*—Sheridan, Ross & McIntosh

[57] ABSTRACT

An overnight letter envelope is provided wherein a pouch is formed between a flexible transparent sheet and the outer surface of one panel of the envelope with the major portions of the lengthwise edges of the flexible transparent sheet being covered by portions of the side panels of the envelope. Cut outs are provided in the side panels so that one widthwise edge of the flexible transparent sheet may be moved away from the outer surface of the panel of the envelope; the airbill inserted into the pouch; a peel away strip removed from the flexible transparent sheet and the flexible transparent sheet secured to the outer surface of the panel of the envelope by self adhering adhesive on the portion of the inner surface of the flexible transparent sheet.

14 Claims, 6 Drawing Figures

OVERNIGHT LETTER ENVELOPE

FIELD OF THE INVENTION

This invention is directed to the field of overnight letters and in particular to an envelope having a transparent pouch secured to an outer surface thereof so that an airbill may be readily inserted into the pouch and thereafter a seal be made between the transparent pouch and the exterior surface of the envelope to retain the airbill in the pouch.

BACKGROUND OF THE INVENTION

In recent years, overnight letter service has grown at a very high rate. In order to provide prompt service and at the same time be able to bill the user, various types of envelopes have been utilized so that the airbill is readily viewable. In one form of envelope, a transparent sheet is adhesively secured to a flexible envelope on three sides to form a pouch. After the airbill has been inserted into the pouch, the remaining side is adhesively secured to the envelope. In another form, an envelope is formed from a sheet of cardboard with side panels on a first panel being secured to the inner surface of a second panel. Before the side panels are secured, a flexible transparent sheet is superposed over the outer surface of the one panel, surfaces of the side panel and a portion of the outer surface of the second panel. Therefore, a portion of the flexible transparent sheet is adhesively secured to the inner surface of the one sheet and the side panels. An overlapping slit is supplied with the transparent flexible sheet so that the slit may be parted and the airbill inserted therein. While these envelopes function to perform a service, it was felt that improvements could be made in the envelopes.

BRIEF SUMMARY OF THE INVENTION

This invention provides an overnight letter envelope that provides a flexible transparent pouch that is securely positioned over an outer surface of the envelope. One edge of the pouch may be readily opened and the airbill inserted. The one edge is then sealed to the outer surface so that the airbill is properly secured in the pouch.

The preferred embodiment of the invention is formed from a sheet of relatively heavy paper or cardboard that is cut and provided with fold lines so as to provide first and second panels, two side panels and a flap. A flexible transparent sheet is superposed over a portion of the outer surface of the second panel and is secured in the superposed position so that lengthwise edges of the flexible transparent sheet are located between the side panels and the outer surface of the second panel. One widthwise edge of the flexible transparent sheet is secured to the outer surface of the second panel adjacent to the fold line between the first and second panels. The other widthwise edge is not secured so as to form a pouch. The side panels are provided with cut outs so that the other widthwise edge of the transparent sheet may be moved outwardly and an airbill inserted into the pouch. The other widthwise edge of the flexible transparent sheet is then secured to the outer surface of the second panel. After the contents of the letter have been inserted into the envelope between the first and second panels, the flap is closed and sealed and the envelope is ready to be deposited at a pick-up location.

It is an object of this invention to provide an overnight letter envelope having a flexible transparent pouch which is readily accessible and sealable.

It is another object of this invention to provide an overnight letter envelope having a flexible transparent pouch with its lengthwise edges protected by the side panels of the envelope.

Other features and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

DETAILED DESCRIPTION OF THE INVENTION

Figure 1:
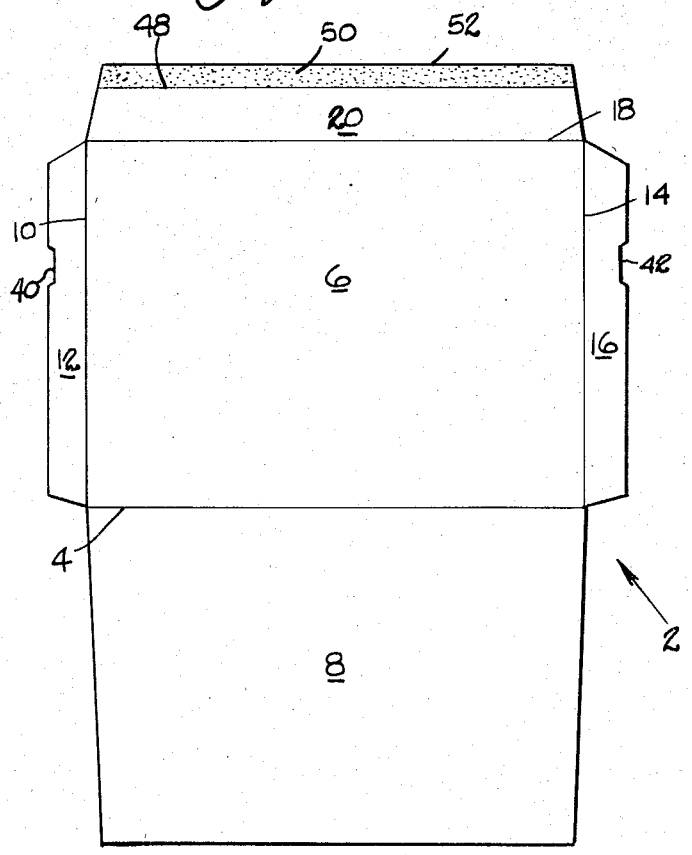
FIG. 1 is a plan view of a blank from which the major portion of the envelope is formed.
Figure 2A:
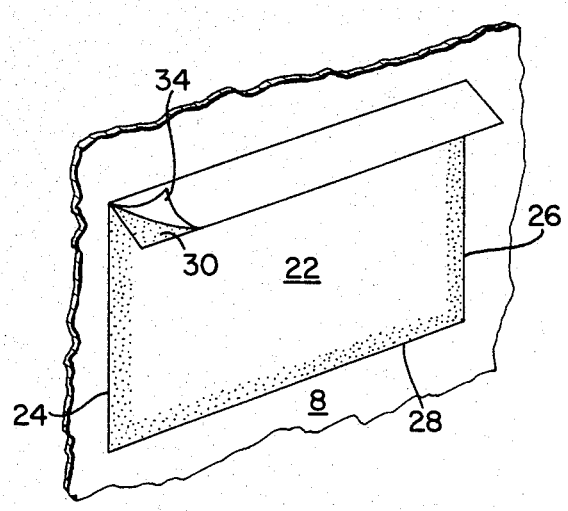
FIG. 2*a* is a pictorial view of a portion of FIG. 2.
Figure 2B:
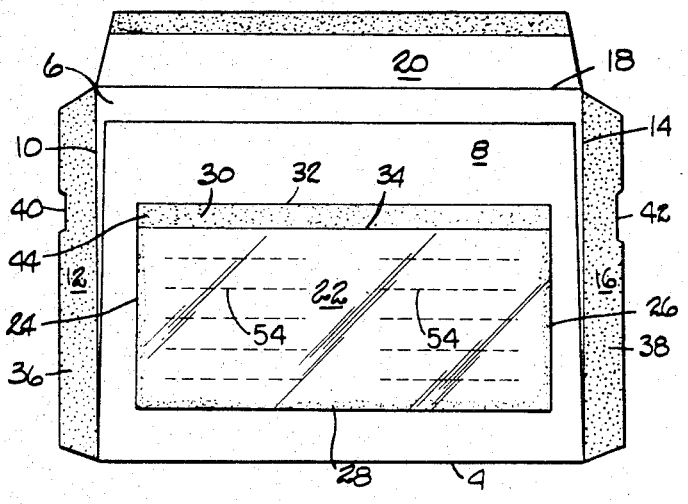
FIG. 2*b* is a modification of the invention illustrated in FIG. 2.
Figure 2C:
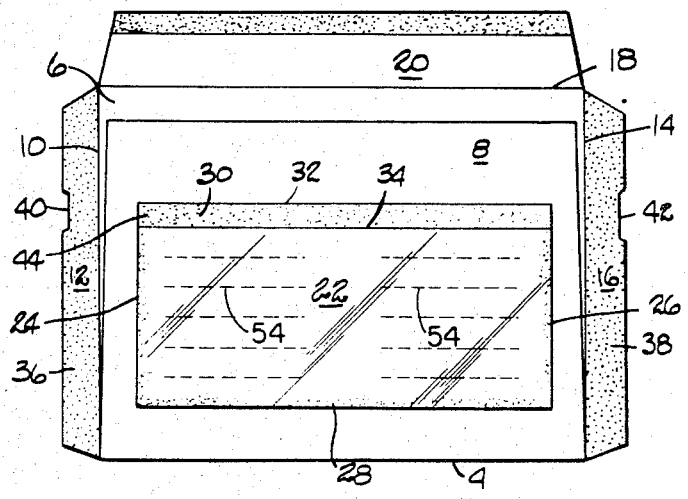
FIG. 2*c* is another modification of the invention illustrated in FIG. 2.

In FIG. 1, there is illustrated generally a blank 2 formed from a relatively heavy paper or light cardboard. The blank is provided with a fold line 4 between a first panel 6 and a second panel 8. A fold line 10 is located between the first panel 6 and a side panel 12 and a similar fold line 14 is located between the first panel 6 and another side panel 16. Finally, a fold line 18 is located between the first panel 6 and a flap 20.

Figure 2:
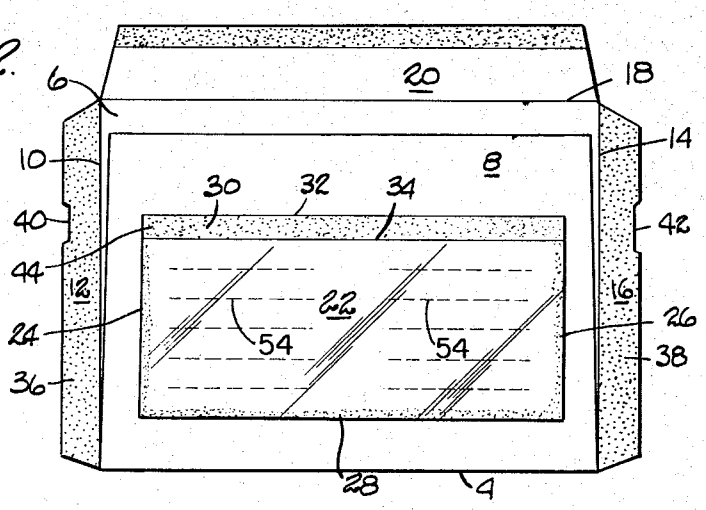
FIG. 2 is a plan view of a partially assembled envelope.

The partially assembled envelope is illustrated in FIG. 2 wherein the second panel 8 has been folded over the fold line 4 to a position wherein it is superposed over the first panel 6. A flexible transparent sheet 22 is placed in superposed position over the outer surface of the second panel 8. In the preferred embodiment, the flexible transparent sheet 22 is secured to the outer surface by adhesive adjacent the lengthwise edges 24 and 26 and the widthwise edge 28 adjacent the fold line 4. The flexible transparent sheet is also provided with a self adhering adhesive 30 along the widthwise edge 32. The self adhering adhesive 30 is covered by a peel away strip 34.

Figure 3:
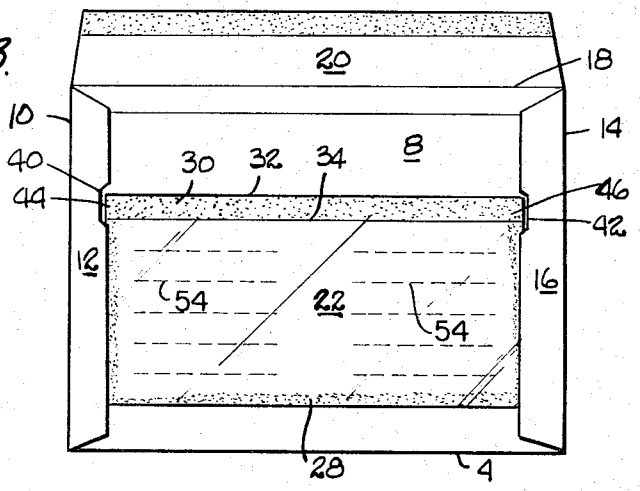
FIG. 3 is a plan view of a fully assembled envelope.

The fully assembled envelope is illustrated in FIG. 3 wherein the side panel 12 has been folded over the fold line 10 and the side panel 16 has been folded over fold line 14 to superposed position over portions of the outer surface of the second panel 8 and the lengthwise edges 24 and 26 of the flexible transparent sheet 22. Prior to being folded, the surface 36 of side panel 12 and the surface 38 of side panel 16 is covered by an adhesive so that the side panels 12 and 16 are secured to the superposed portions of the outer surface of the second panel 8 and the superposed portions of the lengthwise edges 24 and 26 of the flexible transparent sheet 22. The side panel 12 is provided with a cut out portion 40 and the side panel 16 is provided with a cut out portion 42 so that when the panels 12 and 14 have been folded over, the upper portion 44 of the lengthwise edge 24 and the upper portion 46 of the lengthwise edge 26 are not secured in position by any adhesive. Instructional indicia 54 is printed on the outer surface of the second panel 8 covered by the flexible transparent sheet 22.

In another embodiment of the invention, the adhesive along the lengthwise edges 24 and 26 of the flexible transparent sheet 22 is omitted so that the flexible transparent sheet 22 is held in position by the adhesive on the surfaces 36 and 38 and the adhesive along the widthwise edge 28. In still another embodiment of the invention having adhesive along the lengthwise edges 24 and 26, adhesive is omitted from the portions of the surfaces 36 and 38 which are superposed over the portions of the flexible transparent sheet 22 along the lengthwise edges 24 and 26.

In using the overnight letter envelope, the airbill is completed with the required information. The widthwise edge 32 is moved away from the outer surface of the second panel 8 and the airbill is inserted into the pouch formed between the outer surface of the second panel 8 and the inner surface of the flexible transparent sheet 22 by the adhesive along the lengthwise edges 24 and 26 and the widthwise edge 28. The airbill is inserted with the required information adjacent the inner surface of the flexible transparent sheet 22. The peel away strip 34 is removed and the widthwise edge 32 is secured to the outer surface of the second panel 8 by the self adhering adhesive 30. The material to be sent in the overnight letter envelope is then inserted between the inner surfaces of the first panel 6 and the second panel 8; the peel away strip 48 is removed to expose the self adhering adhesive 50 along the edge 52 of the flap 20 and the flap 50 is folded over the fold line 18 and secured in position over portions of the outer surfaces of the side panels 12 and 16 and the second panel 8.

While the preferred embodiments of the invention have been illustrated and described herein, it may be otherwise embodied and practiced within the scope of the following claims.

What is claimed is:

1. An envelope comprising:

a continuous sheet of paper folded once about a fold line to form first and second panels;

said first and second panels having opposed inner surfaces and each having an outer surface;

said first and second panels having substantially the same width but said second panel being shorter in length than said first panel;

each of said panels having two lengthwise edges and two widthwise edges;

a pair of side panels each of which is joined to one of the lengthwise edges of said first panel by a fold line;

each of said side panels having a lengthwise free edge;

each of said side panels having a notch formed in the lengthwise free edges thereof;

a flexible transparent sheet superposed over a portion of said outer surface of said second panel;

said flexible transparent sheet having two lengthwise edges and two widthwise edges;

said side panels being folded over and secured to said outer surface of said second panel so that a major portion of the lengthwise edges of said flexible transparent sheet are located between said outer surface of said second panel and said side panels;

a minor portion of said lengthwise edges of said flexible transparent sheet is exposed at said notches;

means securing said flexible transparent sheet in superposed position over said outer surface of said second panel to form a pouch between said outer surface of said second panel and an inner surface of said flexible transparent sheet;

said pouch being closed on three sides and having an opening located along a widthwise edge of said flexible transparent sheet having portions thereof adjacent said notches;

means adjacent said widthwise edge of said flexible transparent sheet for effecting a seal between said outer surface of said second panel and said flexible transparent sheet when desired; and a flap extending from a widthwise edge of said first panel and having means for effecting a seal between said first and second panels when desired.

2. An envelope as in claim 1 wherein said means securing said flexible transparent sheet in superposed position over said outer surface of said second panel to form a pouch comprises:

adhesive.

3. An envelope as in claim 2 wherein:

said adhesive extends in an area adjacent a widthwise edge of said flexible transparent sheet adjacent the fold line between said first and second panels and in an area adjacent said major portions of said lengthwise edges of said flexible transparent sheet.

4. An envelope as in claim 3 and further comprising:

adhesive between said side panels and said outer surface of said second panel to secure said side panels to said second panel.

5. An envelope as in claim 4 wherein:

said adhesive extends for substantially the full lengthwise extent of said side panels.

6. An envelope as in claim 5 wherein:

the portions of said side panels superposed over the portions of said flexible transparent sheet along the lengthwise edges thereof have no adhesive thereon.

7. An envelope as in claim 6 wherein said means adjacent said widthwise edge of said transparent sheet for effecting a seal between said outer surface of said second panel and said flexible transparent sheet when desired comprises:

a layer of self adhering adhesive on the inner surface of said flexible transparent sheet; and a peel away strip covering said self adhering adhesive.

8. An envelope as in claim 7 wherein said means for effecting a seal between said first and second panel when desired comprises:

a layer of self adhering adhesive on the inner surface of said flap; and a peel away strip covering said self adhering adhesive.

9. an envelope as in claim 1 wherein said means securing said flexible transparent sheet in superposed position over said outer surface of said second panel to form a pouch comprises:

adhesive between said outer surface of said second panel and said flexible transparent sheet extending in an area adjacent a widthwise edge of said flexible transparent sheet adjacent the fold line between said first and second panels; and adhesive between said side panels and said flexible transparent sheet.

10. An envelope as in claim 9 and further comprising:

adhesive between said panels and said outer surface of said second panel to secure said side panels to said second panel.

11. An envelope as in claim 10 and further comprising:

said adhesive extends for substantially the full lengthwise extent of said side panels.

12. An envelope as in claim 11 wherein said means adjacent said widthwise edge of said transparent sheet for effecting a seal between said outer surface of said second panel and said flexible transparent sheet when desired comprises:

a layer of self adhering adhesive on the inner surface of said flexible transparent sheet; and a peel away strip covering said self adhering adhesive.

13. An envelope as in claim 12 wherein said means for effecting a seal between said first and second panel when desired comprises:

a layer of self adhering adhesive on the inner surface of said flap; and a peel away strip covering said self adhering adhesive.

14. An envelope as in claim 13 and further comprising:

instructional indicia printed on said outer surface of said second panel covered by said superposed flexible transparent sheet.

* * * * *